US012538958B2

(12) United States Patent
Hatano et al.

(10) Patent No.: US 12,538,958 B2
(45) Date of Patent: Feb. 3, 2026

(54) SHOE WITH A HEEL GUIDING PORTION

(71) Applicant: ASICS CORPORATION, Hyogo (JP)

(72) Inventors: Genki Hatano, Hyogo (JP); Norihiko Taniguchi, Hyogo (JP); Takayuki Ueda, Hyogo (JP); Katsunori Yagyu, Hyogo (JP); Kei Kanematsu, Hyogo (JP); Hironori Kitayama, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 0 days.

(21) Appl. No.: 18/039,662

(22) PCT Filed: Dec. 16, 2020

(86) PCT No.: PCT/JP2020/046982
§ 371 (c)(1),
(2) Date: May 31, 2023

(87) PCT Pub. No.: WO2022/130537
PCT Pub. Date: Jun. 23, 2022

(65) Prior Publication Data
US 2024/0008593 A1 Jan. 11, 2024

(51) Int. Cl.
*A43B 11/02* (2006.01)
*A43B 23/08* (2006.01)

(52) U.S. Cl.
CPC ..... *A43B 11/02* (2013.01); *A43B 23/088* (2013.01)

(58) Field of Classification Search
CPC ..... A43B 11/02; A43B 23/088
USPC ..... 36/56, 138
See application file for complete search history.

(56) References Cited

U.S. PATENT DOCUMENTS 3,643,350 A * 2/1972 Paoletta ..... A43B 3/0084 36/138
4,608,769 A * 9/1986 Sturlaugson ..... A43B 11/00 36/51
6,880,272 B2 * 4/2005 Wells ..... A47G 25/82 36/105
8,056,264 B2 11/2011 Sato et al.
8,490,298 B2 7/2013 Sato et al.
8,769,845 B2 * 7/2014 Lin ..... A43B 11/02 36/138

(Continued)

FOREIGN PATENT DOCUMENTS

EP 1212954 A1 6/2002
JP S03000750 Y1 2/1928

(Continued)

OTHER PUBLICATIONS

International Search Report issued Feb. 16, 2021 in corresponding International Application No. PCT/JP2020/046982.

(Continued)

*Primary Examiner* — Haley A Smith
(74) *Attorney, Agent, or Firm* — Spencer Fane, LLP

(57) ABSTRACT

A shoe includes a sole, an upper and a heel member. The upper is fixed to the sole and configured to cover a foot of a wearer, the upper including a wearing opening. The heel member is disposed on a heel side of the wearing opening of the upper. The heel member includes a guiding portion configured to guide a heel of the wearer toward the wearing opening and a holding portion configured to hold the guiding portion with respect to the upper at least in a vertical direction.

20 Claims, 13 Drawing Sheets

(56) References Cited

U.S. PATENT DOCUMENTS

| | | | | |
|---|---|---|---|---|
| 12,011,064 | B2 * | 6/2024 | Weeks | A43B 11/00 |
| 2002/0066213 | A1 * | 6/2002 | Wells | A43B 3/0084 223/118 |
| 2012/0180338 | A1 * | 7/2012 | Lin | A43B 9/02 36/56 |
| 2020/0196787 | A1 * | 6/2020 | Dament | A47G 25/82 |
| 2024/0032645 | A1 * | 2/2024 | Munger | A47G 25/82 |

FOREIGN PATENT DOCUMENTS

| | | | |
|---|---|---|---|
| JP | S10000862 | Y1 | 1/1935 |
| JP | S5419845 | A | 2/1979 |
| JP | S61113609 | U | 7/1986 |
| JP | S62128409 | U | 8/1987 |
| JP | H0172107 | U | 5/1989 |
| JP | H0970301 | A | 3/1997 |
| JP | H10192125 | A | 7/1998 |
| JP | 2008132227 | A | 6/2008 |
| JP | 3184605 | U | 7/2013 |
| JP | 3212460 | U | 9/2017 |
| JP | 2019092988 | A | 6/2019 |

OTHER PUBLICATIONS

International Preliminary Report on Patenability issued Feb. 16, 2021 in corresponding International Application No. PCT/JP2020/046982.

Supplementary European Search Report issued Nov. 7, 2023 in corresponding European Application No. 20965925.9.

Japanese Office Action of corresponding JP Application No. 2022-569396 dated Sep. 3, 2024.

Notification of Reason for Refusal received for Japanese Patent Application No. 2022-569396, mailed on Jan. 28, 2025, 6 pages. (English Translation Submitted).

* cited by examiner

SHOE WITH A HEEL GUIDING PORTION

CROSS-REFERENCE TO RELATED APPLICATION

This application is a U.S. National Stage application of PCT/JP2020/046982, filed Dec. 16, 2020, the contents of which are hereby incorporated by reference.

BACKGROUND

Technical Field

The present disclosure relates to a shoe.

Background Information

Conventionally shoes equipped with heel counters have been known to improve the stability of the wearer's calcanei and the retention of the heel shape when the wearer wears the shoe. For a heel counter, a hard member is generally used, which has extends along the outermost edge of the calcaneus in a top view. Such a heel counter is often applied, for example, to a shoe used for exercise in which the stability of the wearer's heel portion is required, such as running and walking (see Japanese Unexamined Patent Application Publication No. 2008-132227, for example).

SUMMARY

Meanwhile, it has been determined that when putting on a shoe, smoothly inserting the foot may be difficult when the wearing opening of the shoe is tightened or has a hard structure.

Embodiments of the present invention solve such a problem, and a purpose of these embodiments is to provide a shoe having a structure that enables smooth insertion of a foot when a wearer puts on the shoe, while improving the stability of the calcaneus.

To accomplish the purpose above, an embodiment of the present invention includes a sole, an upper that is fixed to the sole and covers a foot of a wearer, and a heel member disposed on the heel side of a wearing opening of the upper. The heel member includes a guiding portion that guides a heel of a wearer toward the wearing opening, and a holding portion that holds the guiding portion with respect to the upper at least in a vertical direction.

DETAILED DESCRIPTION

Definitions of terms used in this specification will be described first. In this specification, front and rear directions, width directions, and vertical directions can be used as terms indicating directions. These terms indicate directions viewed from a viewpoint of a wearer wearing a shoe placed on a flat surface. Accordingly, the front direction means a direction toward the toe side, and the rear direction means a direction toward the heel side. Also, a medial side and a lateral side of a foot can be used as terms indicating directions. The medial side of a foot means the inner side of the foot in a width direction, i.e., the big toe (first toe) side of the foot, and the lateral side of the foot means the side opposite to the medial side along a width direction.

Further, in the following description, directions can be described using a three-dimensional Cartesian coordinate system. In this case, the X-axis extends from the medial side toward the lateral side of the foot, the Y-axis extends from the heel side toward the toe side, and the Z-axis extends from the bottom surface side toward the upper side.

Before a shoe according to an embodiment is described, a foot skeleton relevant to the shoe according to the embodiment will be described with reference to FIG. 1.

Figure 1:
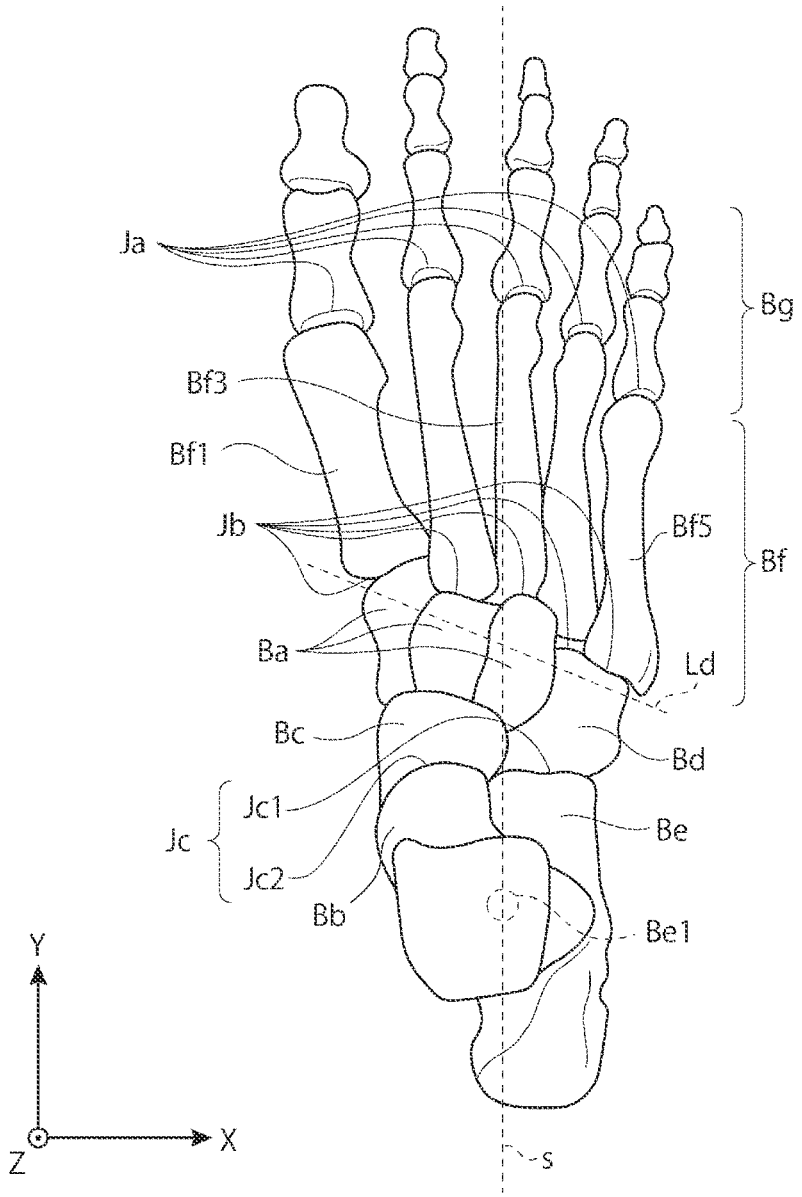
FIG. 1 is a top view of a foot skeleton.

FIG. 1 is a top view of a foot skeleton. A human foot is mainly formed by cuneiform bones Ba, a cuboid bone Bd, a navicular bone Bc, a talus Bb, a calcaneus Be, metatarsal bones Bf, and phalanges Bg. In FIG. 1, a center line S indicates a center line of a shoe and extends along a middle part in a foot width direction. The center line S is assumed to be a region positioned on a straight line passing through a third metatarsal bone Bf3 and a medial process Bel of calcaneal tuberosity of the calcaneus Be in a human body. FIG. 1 shows an area where the medial process Bel of calcaneal tuberosity is assumed to be positioned, and this area can hereinafter be referred to as the "heel center Hc".

Figure 2:
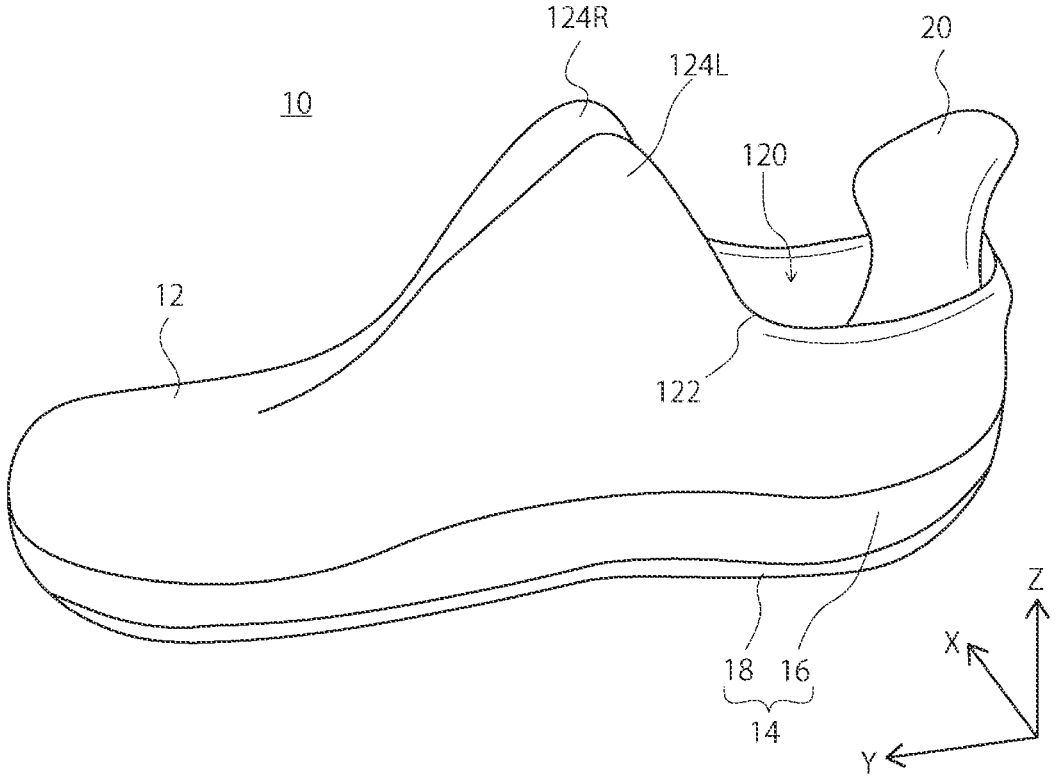
FIG. 2 is a perspective view of a shoe.

FIG. 2 is a perspective view of a shoe. As illustrated in FIG. 2, a shoe 10 includes an upper 12 and a sole 14. The upper 12 has a shape that wraps around the instep of a wearer.

The upper 12 is joined to the sole 14 along the outer circumference of the sole 14. In a top part of the upper 12, a wearing opening 120 is disposed so as to surround the ankle of the wearer. As the upper 12, various types of uppers can be employed, such as the upper of a laced shoe of which, fit is adjustable with laces, a slip-on shoe or a monosock shoe that does not include a fastening device such as laces, or the like.

The wearing opening 120 is an opening that receives a foot of a wearer when putting on the shoe 10 in the order of the toe, the midfoot portion, and the heel. An edge part 122 of the upper 12 forming the wearing opening 120 has a wavy shape protruding upward at the toe and heel sides and downward at the left and right sides. The wearing opening 120 is formed to widen when force is applied from the inside. The widening of the wearing opening 120 means that the opening area of the wearing opening 120 expands. As a specific case where the wearing opening 120 widens, the case can be considered where, when force is applied from the inside of the wearing opening 120 to the edge part 122, which is formed to be stretchable, the edge part 122 stretches, or where the edge part 122 is deformed, and the opening area of the wearing opening 120 expands, as will be described later. The edge part 122 and the vicinity thereof (especially the toe side) can preferably have higher stretchability than other portions constituting the upper 12.

Also in the following case, it is considered that the shoe 10 has a structure in which the wearing opening 120 widens.

Figure 3:
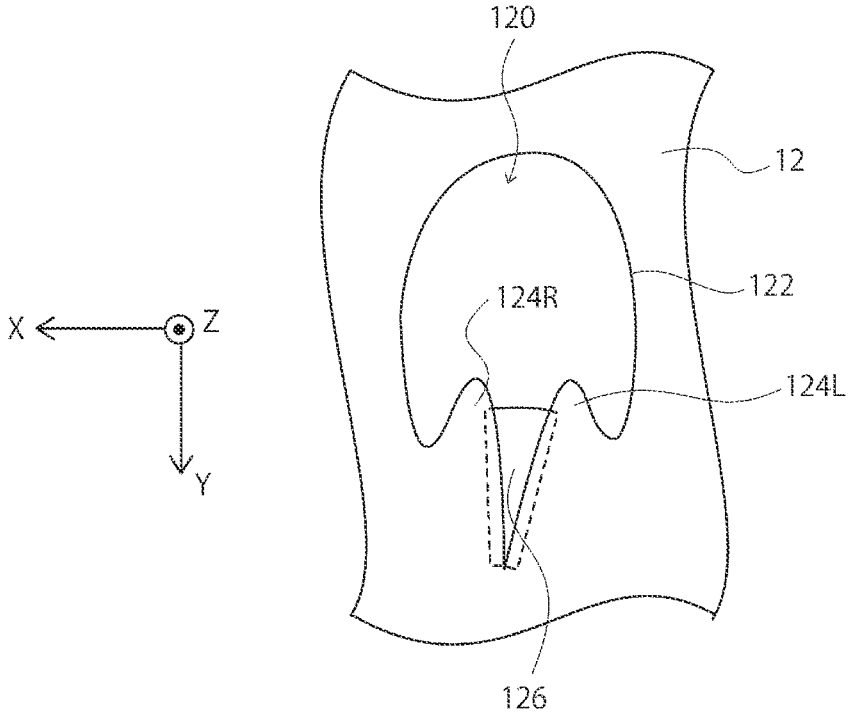
FIG. 3 is a top view that shows the vicinity of a wearing opening.
Figure 4:
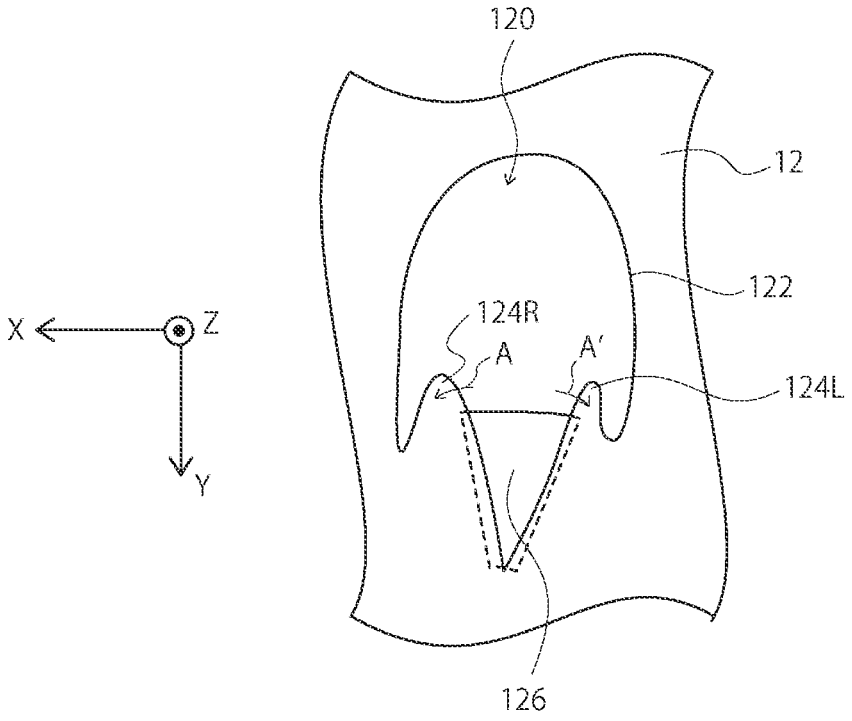
FIG. 4 is a top view that shows the vicinity of the wearing opening.

FIGS. 3 and 4 are top views that show the vicinity around the wearing opening. As illustrated in FIG. 3, illustrates an embodiment in which the wearing opening 120 includes two pieces 124R and 124L arranged with a cut in between. Each of the pieces 124R and 124L is pulled by a stretchable member 126 having elasticity, toward the inner side in a width direction. When the pieces 124R and 124L are pushed from the inside against the stretchable member 126 and separated respectively in the directions of arrows A and A' as shown in FIG. 4, the wearing opening 120 widens.

The configuration of the expandable wearing opening 120 is not limited thereto; the edge part 122 can be configured only by a stretchable part, or other structures can be employed.

Referring back to FIG. 2, the sole 14 includes a midsole 16 and an outsole 18. In the following, although the sole shape and the like can be referred to, the term "sole" means the entire sole 14 including the midsole 16 and the outsole 18, unless otherwise explicitly specified. Also, the sole 14 can be formed by either the midsole 16 or the outsole 18.

The midsole 16 absorbs impact, and part of or the entirety of the midsole 16 is formed of a soft material for absorbing impact, which can be a foam material, such as expanded EVA, urethane foam, or foamed thermoplastic elastomer, GEL, or cork, for example. The material of the midsole 16 can suitably have the Young's modulus of 10 MPa or less (when the strain is 10%) or a value measured using the ASKER Durometer Type C of 70 or less.

The outsole 18 is formed by shaping multiple rubbers into a predetermined shape. The outsole 18 is pasted over the bottom surface of the midsole 16 so as to cover at least part of the bottom surface of the midsole 16.

The shoe 10 also includes a heel member 20. The heel member 20 is disposed inside the wearing opening 120. The heel member 20 is disposed along a heel side area of the edge part 122. The heel member 20 is fixed to at least one of the upper 12 or the sole 14, and a top part of the heel member 20 protrudes above a top edge of the wearing opening 120.

Figure 5:
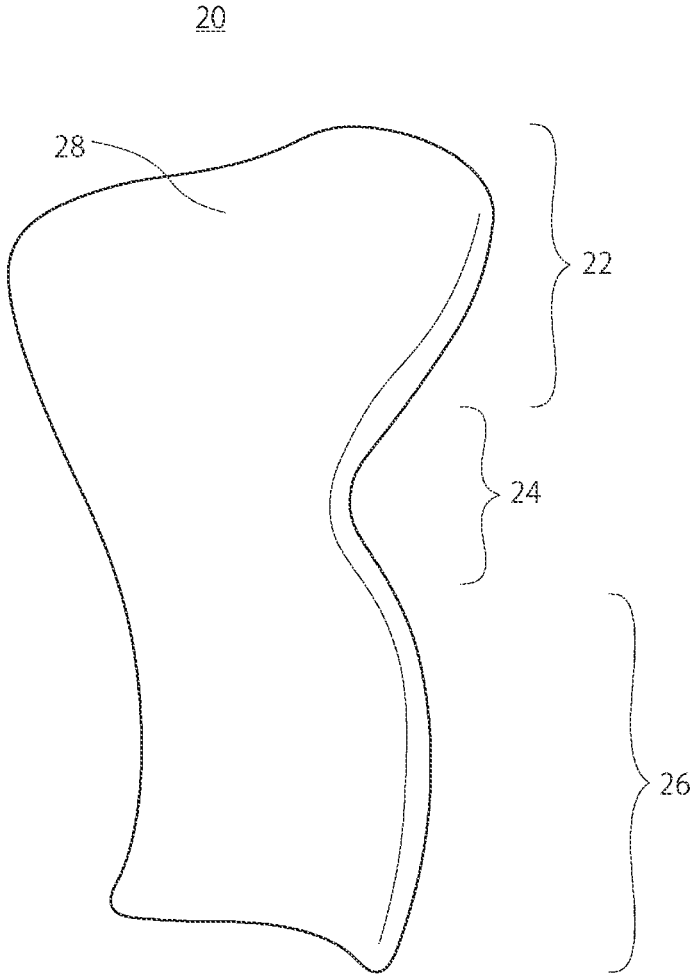
FIG. 5 is a perspective view of a heel member.
Figure 6:
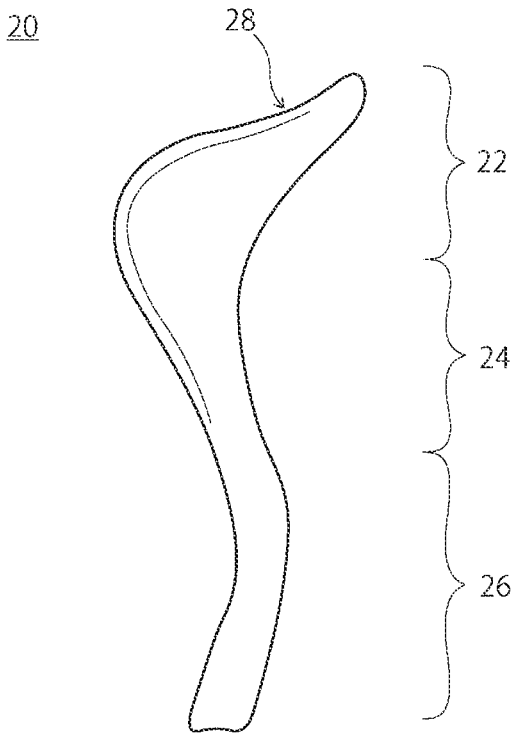
FIG. 6 is a side view of the heel member.
Figure 7:
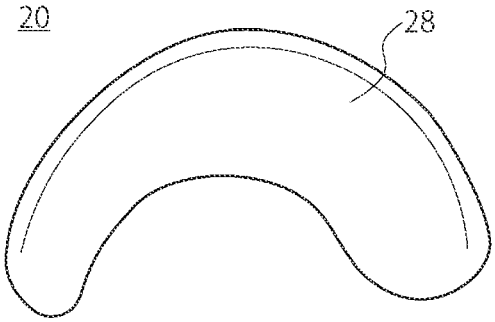
FIG. 7 is a top view of the heel member.
Figure 8:
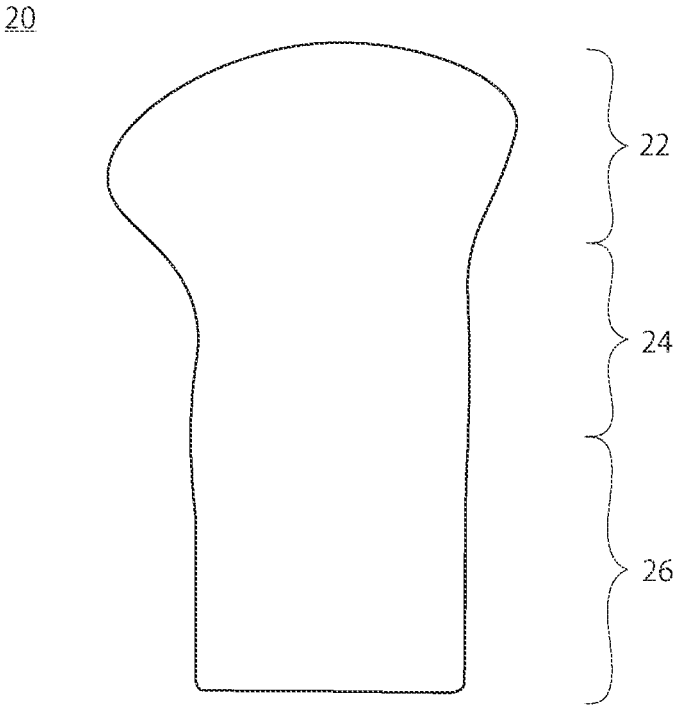
FIG. 8 is a rear view of the heel member.
Figure 9:
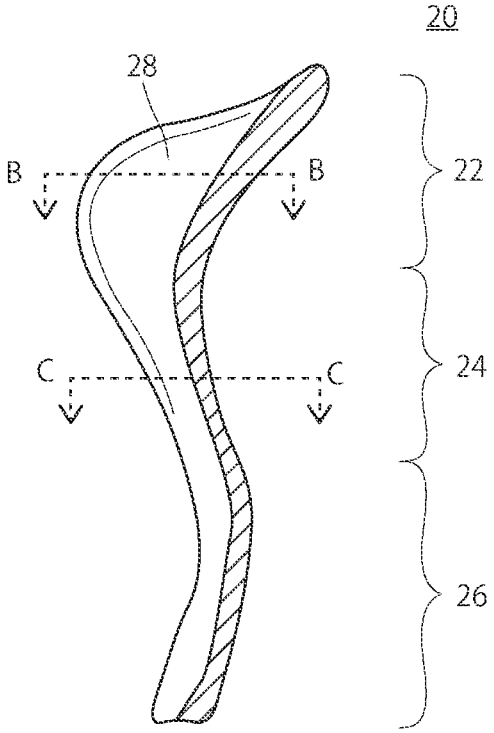
FIG. 9 is a longitudinal sectional view of the heel member.
Figure 10:
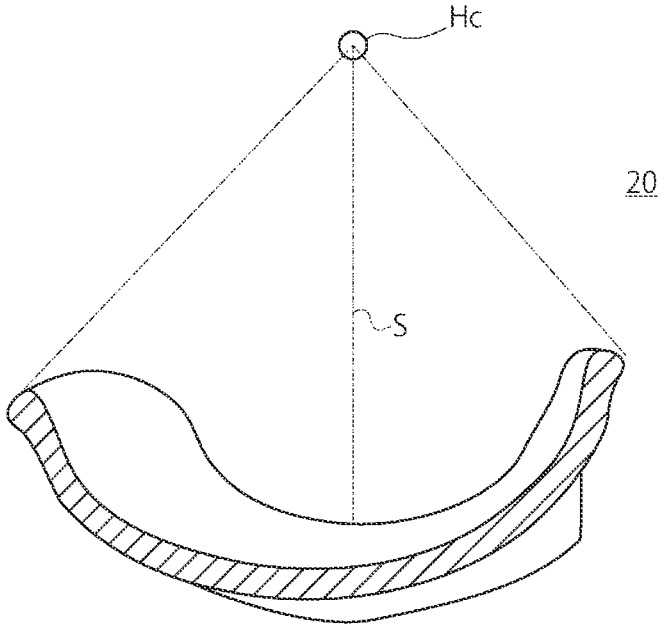
FIG. 10 is a sectional view taken along line B-B in FIG. 9.
Figure 11:
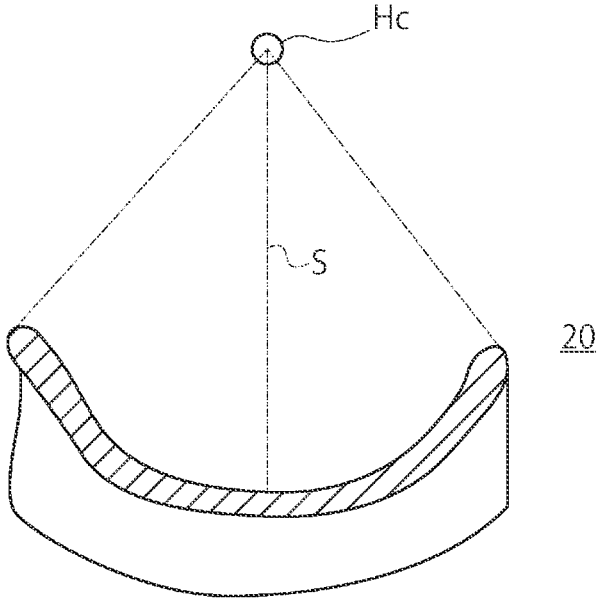
FIG. 11 is a sectional view taken along line C-C in FIG. 9.

FIG. 5 is a perspective view of the heel member, FIG. 6 is a side view of the heel member, FIG. 7 is a top view of the heel member, and FIG. 8 is a rear view (viewed from the heel side) of the heel member. FIG. 9 is a longitudinal sectional view of the heel member and shows a cross section along the middle in a width direction of the heel member. FIG. 10 is a sectional view taken along line B-B in FIG. 9, and FIG. 11 is a sectional view taken along line C-C in FIG. 9.

As illustrated in FIG. 5 through FIG. 8, the heel member 20 has a deformed shape formed by one plate-like member that is vertically continuous and partially curved. Being vertically continuous means that, when a longitudinal cross section of the heel member 20 is taken, at least one longitudinal cross section that is continuous over a vertical direction can be taken. Therefore, even if a hole penetrating through the heel member 20 in front and rear directions is formed, when at least one continuous longitudinal cross section can be taken, the heel member 20 is considered to be vertically continuous. The heel member 20 has a shape approximately in the vicinity of the heel of a wearer. Also, a horizontal cross section of the heel member 20 has a curved shape that opens on the toe side. The curved shape forms a U-shape, and the opening width of the curved shape varies depending on the height position. The opening width is a distance between both ends of the receiving surface in a width direction on a horizontal cross section.

The heel member 20 has a height such that the top end is positioned higher than the wearing opening 120, and the lower end reaches at least the top surface of the sole 14. The heel member 20 is formed by solidifying a resin-based material, such as a chemical sheet. As the heel member 20, a pressed or an injection-molded resin material can also be used. Also, the heel member 20 has a hardness such that it remains unbent against compression in a Z-axis direction even when the weight of the wearer is applied from above. The hardness of the heel member 20 can suitably be 10 Mpa or higher, for example.

The heel member 20 includes a guiding portion 22, a heel holding portion 24 as an intermediate portion, and a fixing portion 26. The guiding portion 22, heel holding portion 24, and fixing portion 26 are integrally formed in this order along a Z-axis direction. The guiding portion 22, heel holding portion 24, and fixing portion 26 are concepts indicating areas of the heel member 20 integrally formed; accordingly, the guiding portion 22, heel holding portion 24, and fixing portion 26 need not necessarily be functionally or visually separated, and the dimensional proportions in the height direction need not be as illustrated.

The guiding portion 22 guides the wearer's heel in a predetermined direction when the wearer puts on the shoe 10. The motions involved when putting on the shoe 10 include placing the toe inside the upper 12 with the ankle extended (hereinafter, referred to as a "first motion"), and moving the entire foot toward the toe side while gradually bringing the ankle angle closer to 90 degrees (hereinafter, referred to as a "second motion"). The motions involved when putting on the shoe 10 terminate when the foot entirely contacts with the top surface of the sole 14, and the ankle angle reaches 90 degrees. The guiding portion 22 guides the heel toward the toe side during at least the second motion. The guiding portion 22 can guide the heel toward the toe side during the first and second motions.

The guiding portion 22 is formed in a height range where at least part of the guiding portion 22 protrudes upward mainly from the wearing opening 120. The guiding portion 22 includes a receiving surface 28. The surface of the receiving surface 28 is smoothly formed so that the wearer's foot will not be trapped.

As illustrated in FIG. 5 through FIG. 10, the receiving surface 28 has a shape like a vertically divided funnel. In other words, the receiving surface 28 has a shape as if the hatched cross section shown in FIG. 9 were rotated by a predetermined angle around a vertical axis that passes through the center of the heel. In a top view, the receiving surface 28 has a curved shape forming a U-shape that opens on the toe side. The receiving surface 28 is formed by a curved surface inclined toward the toe side and the inner side (the side on which the center of the heel is located when viewed from the top). The opening width of the receiving surface 28 is widest at the top side and tapers toward the lower side. The receiving surface 28 can preferably have a spread of 30 to 60 degrees around the heel center Hc (with respect to the center line S, 15 to 30 degrees on each side of the center line S). A rear end of the receiving surface 28 is positioned at the highest point in the heel member 20. Accordingly, when a wearer puts on the shoe 10, the rear end of the receiving surface 28 first comes into contact with the foot.

The receiving surface 28 can be a horizontal surface instead of an inclined surface. In other words, when the shoe 10 is placed on a virtual plane, the receiving surface 28 can be formed as a surface parallel to the virtual plane. This is because, since the wearer is moving the foot toward the toe side during the first motion or the second motion, even if the receiving surface 28 is a horizontal surface, the heel can be guided toward the toe side.

The heel holding portion 24 includes a hollow portion or shape on both sides above the wearer's calcaneus Be (i.e., holding portion 24 is hollow near both sides of the calcaneal tendon attachment site). The heel holding portion 24 fits the hollow portions of the foot of the wearer in a width direction. The heel holding portion 24 contacts the foot in the vicinity of the heel of the wearer wearing the shoe 10 from both sides, thereby stabilizing the heel portion of the wearer in the width direction. The heel holding portion 24 fits the calcaneus Be of the wearer from above. Accordingly, the heel holding portion 24 contacts a site corresponding to the calcaneus Be when the calcaneus Be is moved upward. This makes the shoe 10 less likely to come off.

The heel holding portion 24 is formed by a curved surface continuous with the receiving surface 28. The heel member 20 includes a constricted area, which corresponds to the heel holding portion 24 (see particularly FIG. 11). The heel holding portion 24 has a curved shape forming a U-shape that opens on the toe side. The opening width of the U-shape of the heel holding portion 24 is at least smaller than the opening width of the U-shape of the guiding portion 22. The opening width of the U-shape of the heel holding portion 24 can be smallest in the heel member 20 having a U-shape overall. The heel holding portion 24 can preferably have a spread of 10 to 30 degrees around the heel center Hc (with respect to the center line S. 5 to 15 degrees on each side of the center line S).

The fixing portion 26 as a holding portion makes the entire heel member 20 unable to move with respect to the upper 12 or the sole 14. The fixing portion 26 is fixed to at least one of the inner surface of the upper 12, the top surface of the sole 14, or an inner sole part (not illustrated). With the fixing portion 26 fixed to the upper 12 or the sole 14, the heel member 20 is less likely to fall rearward during the motions for putting on the shoe 10 and while the wearer is moving wearing the shoe 10. When the fixing portion 26 is fixed to the upper 12 or the sole 14, the fixing portion 26 can be fixed to the inner surface of the upper by a fixing means or element, such as an adhesive, or can be fixed by sewing. Also, a pocket can be provided on the inner surface of the upper 12, and the heel member 20 can be inserted into the pocket, for example. This enables replacement of the heel member 20.

The heel member 20 can be prepared after each dimension thereof, such as the opening width, is adjusted according to the intended use. Also, the heel member 20 can be formed in a custom-made form for each wearer by taking a mold of the heel of the wearer.

Figure 12:
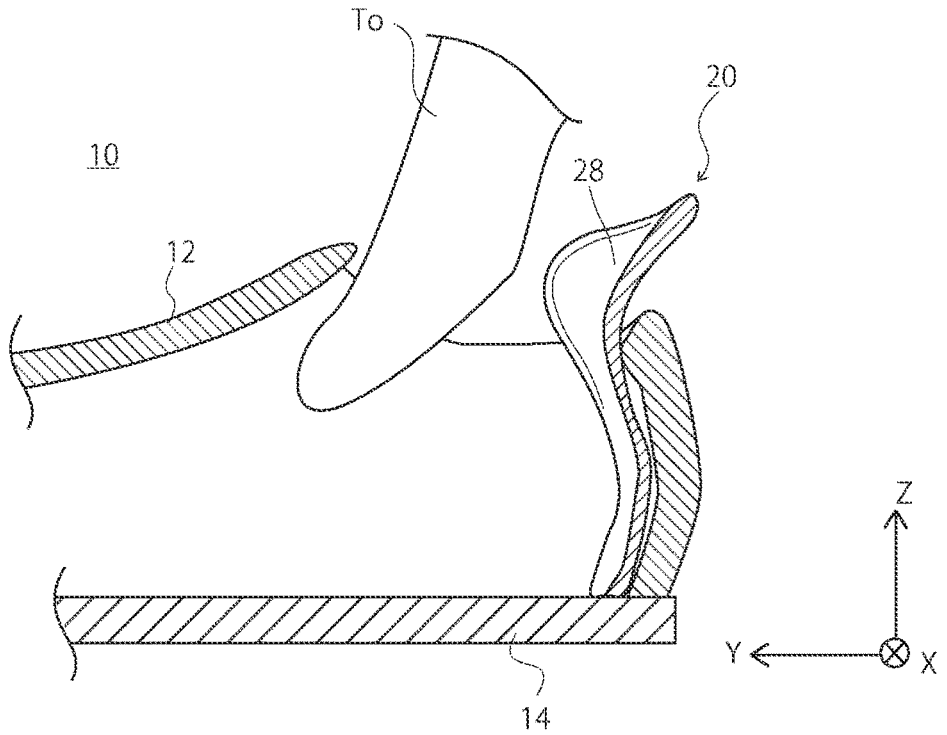
FIG. 12 is a longitudinal sectional view along a center line of the shoe.
Figure 13:
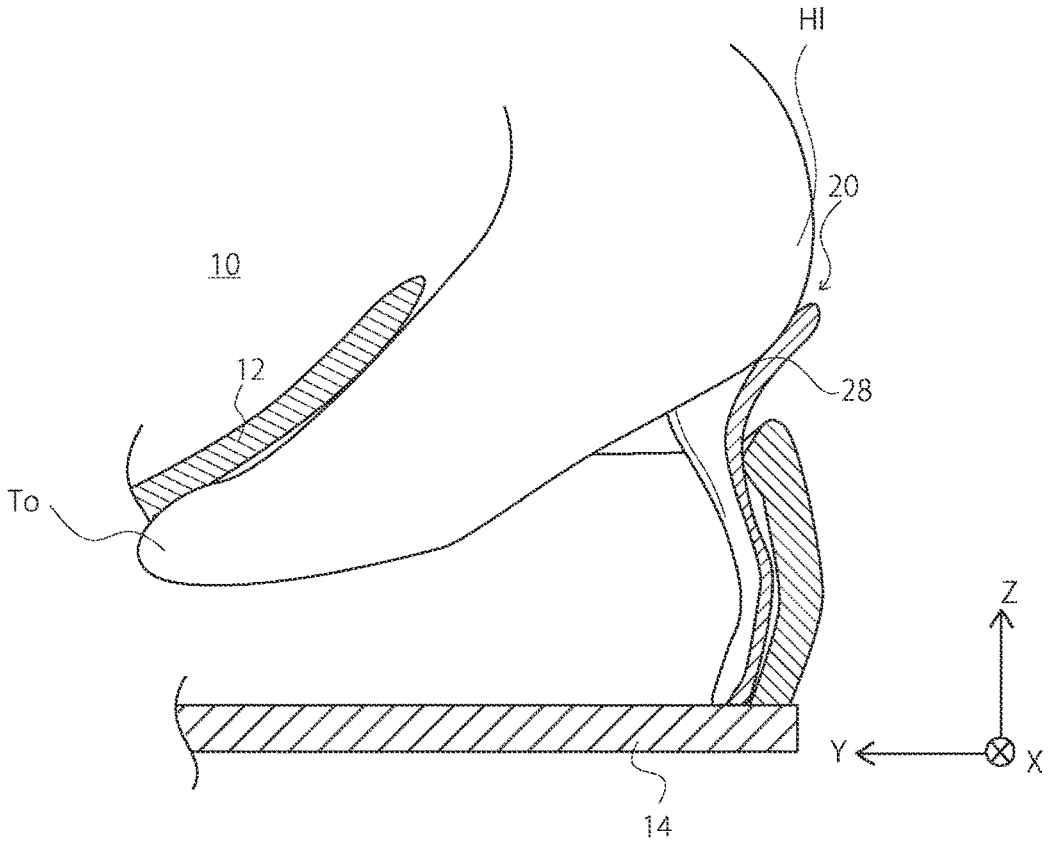
FIG. 13 is a longitudinal sectional view along the center line of the shoe.
Figure 14:
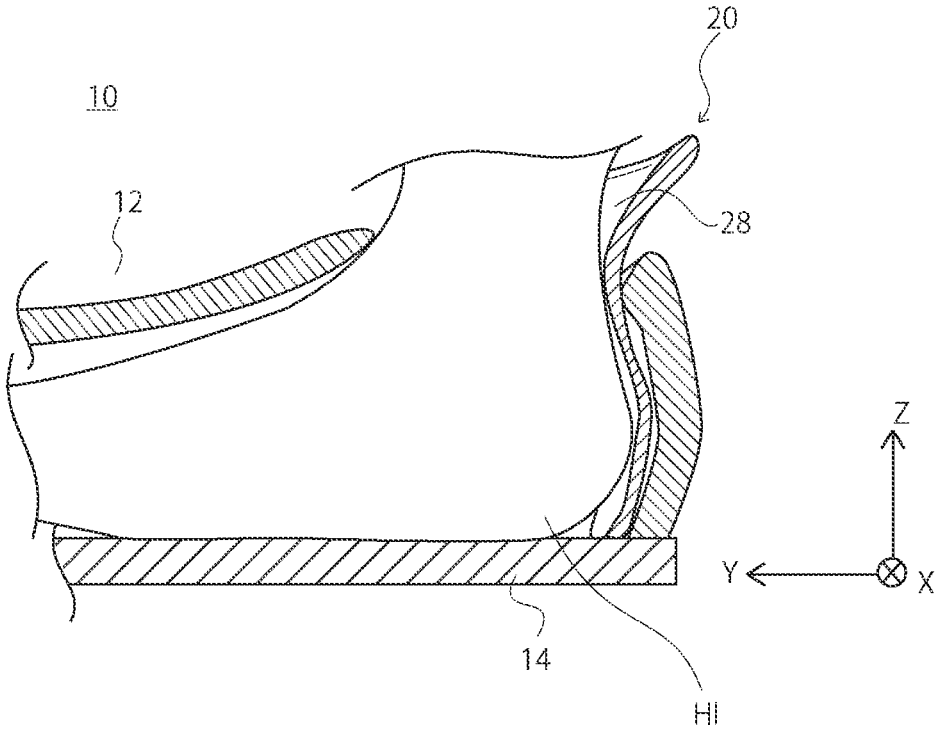
FIG. 14 is a longitudinal sectional view along the center line of the shoe.

The functions of the shoe 10 will now be described. Each FIG. 12 through FIG. 14 is a longitudinal sectional view along the center line of the shoe. FIG. 12 illustrates the state of a wearer performing the first motion, and FIG. 13 illustrates the state of the wearer performing the second motion. FIG. 14 illustrates the state where the shoe 10 is worn.

As illustrated in FIG. 12, in the first motion, the wearer places the toe inside the upper 12 with the ankle extended. During the first motion, the wearer's heel can touch the guiding portion 22. When the heel of the wearer touches the guiding portion 22, the heel slides toward the toe side on the receiving surface 28 of the guiding portion 22. Accordingly, the guiding portion 22 can guide the heel toward the toe side and, in turn, can guide the entire foot toward the toe side.

As illustrated in FIG. 13, in the second motion, the wearer moves the entire foot toward the toe side while gradually bringing the ankle angle closer to 90 degrees. When the heel of the wearer touches the guiding portion 22 in this state, the heel slides toward the toe side on the receiving surface 28 of the guiding portion 22. Accordingly, the guiding portion 22 can guide the heel toward the toe side and, in turn, can guide the entire foot toward the toe side. When the wearer's heel touches the guiding portion 22, the wearer's weight is applied to the heel member 20; however, since the heel member 20 is formed of a hard material, the heel member 20 can be preferably configured such that it can fall slightly rearward around the fixing portion 26 but is not compressed and deformed. When the heel is guided by the guiding portion 22, the front of the ankle of the wearer contacts the edge part 122 of the wearing opening 120. When the toe side portion of the wearing opening is stretchable, the wearing opening 120 widens in the width directions. As the wearing opening 120 widens, the force pushing the heel member 20 rearward is reduced.

As illustrated in FIG. 14, when the wearer is wearing the shoe 10, the heel member 20 stands upright in a position along the heel of the wearer. In this state, the heel holding portion 24 is suitably in contact with the heel of the wearer and holds the heel. When the wearer moves, the foot intensely moves in the front and rear directions within the shoe 10; therefore, even if the heel holding portion 24 and the foot are slightly spaced apart when the wearer is at rest, the functions of the heel member 20 will not be impaired.

As described above, with the shoe 10, the wearer can smoothly perform the motions for putting on the shoe 10. Such a configuration is not only suitable for running and walking shoes, but also for shoes for performances, such as dances, and shoes for elderly persons and children. Also, since the heel member 20 can hold the heel of the wearer, the stability of the calcaneus can be improved.

Also, by disposing the rear end of the receiving surface 28 at the highest position in the heel member 20, the receiving surface 28 can be brought into contact with the foot first when the shoe 10 is worn. This contact can inform the wearer of the position of the receiving surface 28.

Also, by narrowing the opening width of the heel holding portion 24, the vicinities of both sides of the calcaneal tendon attachment site can be held, thereby stabilizing the heel portion in the width direction.

Modifications of the present embodiment will now be described.

Figure 15:
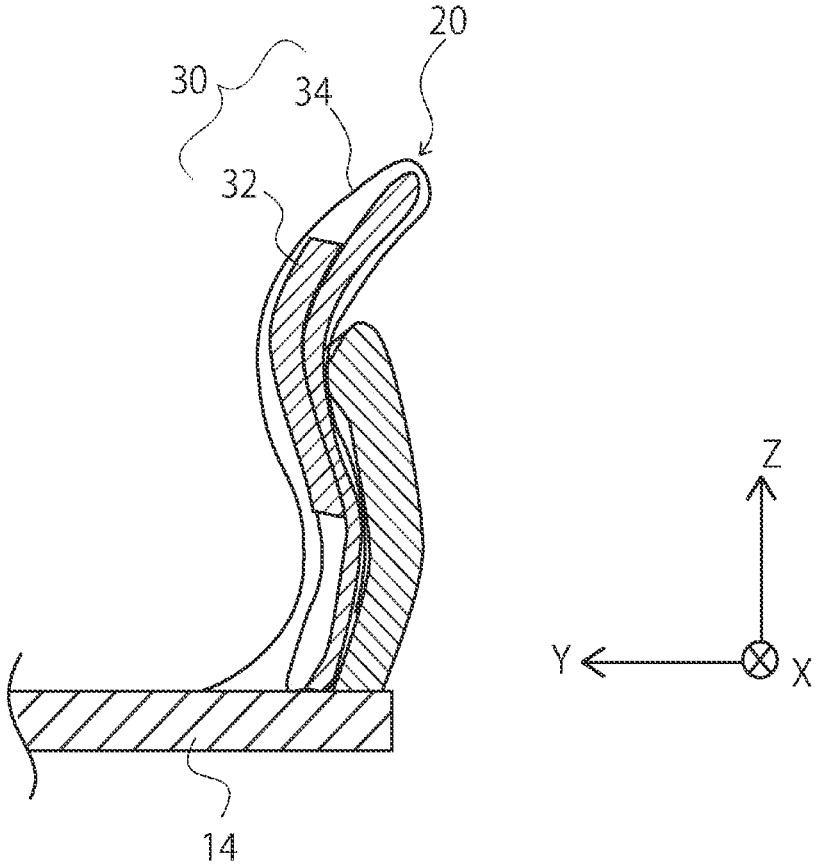
FIG. 15 is a longitudinal sectional view of a shoe according to a modification.

FIG. 15 is a longitudinal sectional view of a shoe according to a modification. As illustrated in FIG. 15, on a surface of the heel member 20, a buffer member 30 can be disposed. In the illustrated example, a sponge 32 and a covering 34 are used as the buffer member 30. Also, only the sponge 32 or only the covering 34 can be used as the buffer member 30. For the covering 34, synthetic fiber, artificial leather, or natural leather can be used. When the covering 34 is applied to the heel member 20, a corresponding fitting-type fixing means or element can be dispose in each of the fixing portion 26 and the body of the upper 12, so that the fixing portion 26 can be fixed to the upper 12 by the fixing means.

When the covering 34 is applied to the heel member 20, by providing an opening/closing part, such as a fastener, on the covering 34, the heel member 20 can be replaceable.

The buffer member 30 is disposed at least on the toe-side surface of the heel member 20. The buffer member 30 covers at least the heel holding portion 24. The buffer member 30 can also cover the entire heel member 20 including the guiding portion 22 and the fixing portion 26. When the sponge 32 is used as the buffer member 30, it is suitable to cover only the toe-side surface of the heel member 20. When the covering 34 is used as the buffer member 30, the entire heel member 20 can be covered. The buffer member 30 prevents the hard heel member 20 from coming into contact with the foot directly and improves the wearing comfort of the shoe 10.

Figure 16:
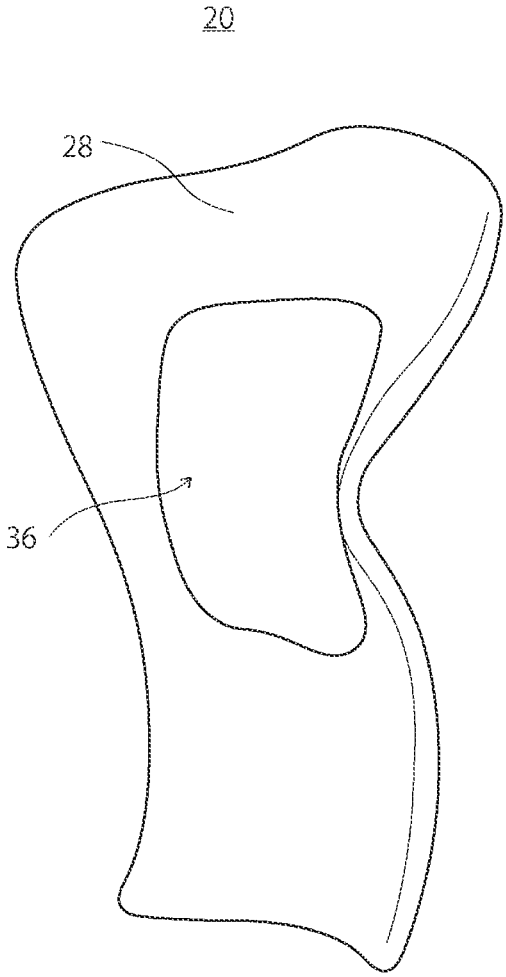
FIG. 16 is a perspective view of a heel member according to a modification.
Figure 17:
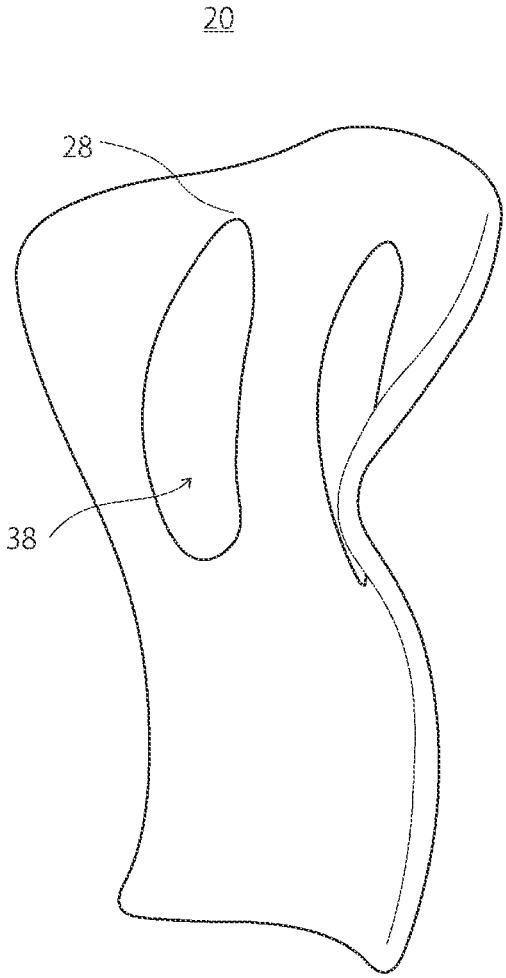
FIG. 17 is a perspective view of a heel member according to a modification.
Figure 18:
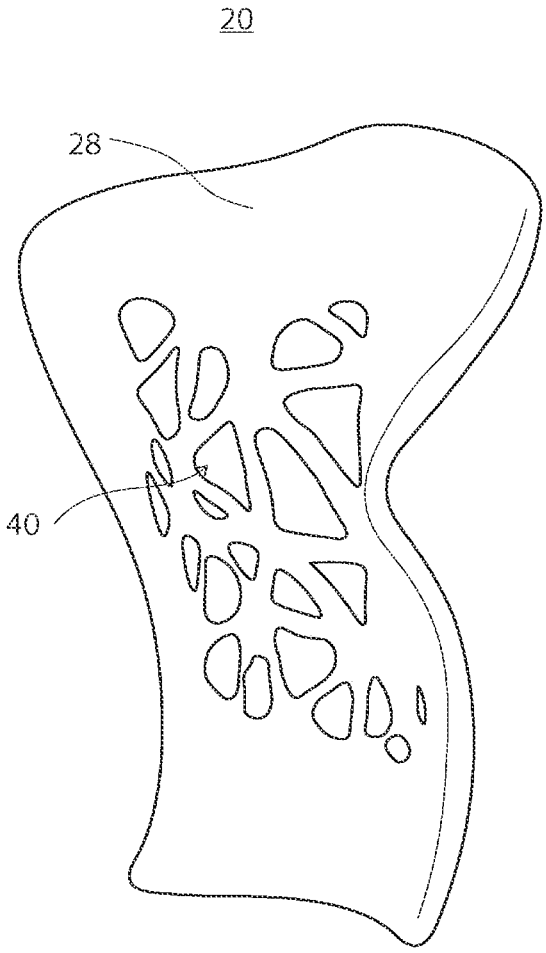
FIG. 18 is a perspective view of a heel member according to a modification.

FIG. 16 through FIG. 18 are perspective views of heel members according to modifications. As illustrated in FIG. 16 through FIG. 18, the heel member can be provided with one or more through holes penetrating in front and rear directions.

In the example shown in FIG. 16, the heel member 20 includes a large through hole 36 formed from the guiding portion 22 to the heel holding portion 24. The through hole 36 has an oval shape when viewed from the front. The shape of the through hole 36 is not limited to an oval shape and can be any shape that is not edgy and does not worsen the smoothness for a foot. The through hole 36 enables adjustment of the strength of the heel member 20 on a horizontal cross section. Also, with the through hole 36, when the wearer's weight is applied to the heel member 20 during the second motion, for example, the opening width of the heel member 20 can easily slightly widen. Accordingly, the heel member 20 is less likely to be an obstacle when the wearer is performing the second motion. Also, when the buffer member 30 and the through hole 36 are used together, the through hole 36 can be an evacuation space for the buffer member 30. Accordingly, when the buffer member 30 is pressed by the heel, the buffer member 30 is deformed and partially evacuated into the through hole 36. Therefore, even when the buffer member 30 is relatively thick, for example, the wearing comfort of the shoe 10 is less likely to be impaired.

In the example shown in FIG. 17, the heel member 20 includes two large through holes 38 formed from the guiding portion 22 to the heel holding portion 24. Also, in the example shown in FIG. 18, the heel member 20 includes multiple through holes 40 formed by the Delaunay triangulation. When the heel member 20 is viewed from the front, through holes 40 in the center have larger openings, and through holes 40 near the periphery have smaller openings. Such through holes 38 and 40 can be expected to have an effect equivalent to that of the through hole 36.

Figure 19:
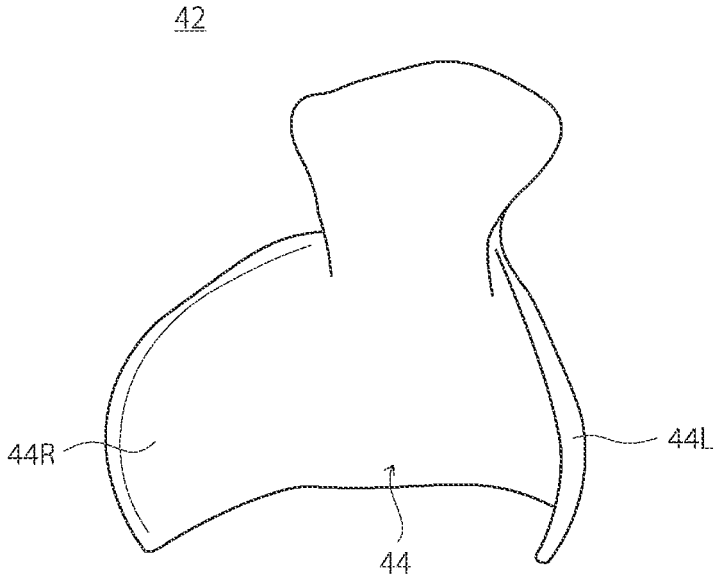
FIG. 19 is a perspective view of a heel member according to a modification.

FIG. 19 is a perspective view of a heel member according to a further modification. As illustrated in FIG. 19, a heel member 42 includes a heel side holding portion 44 that holds the wearer's heel at the sides when the wearer's foot is placed on the sole 14 (see FIG. 2). The heel side holding portion 44 includes a left side holding portion 44L and a right side holding portion 44R extending from both sides of the fixing portion 26 toward the toe side. The heel side holding portion 44 has a three-dimensional curved surface shape that wraps around the wearer's heel from the rear and both sides, in cooperation with the fixing portion 26. The heel side holding portion 44 can be regarded as the fixing portion 26 with a widened opening width.

Figure 20:
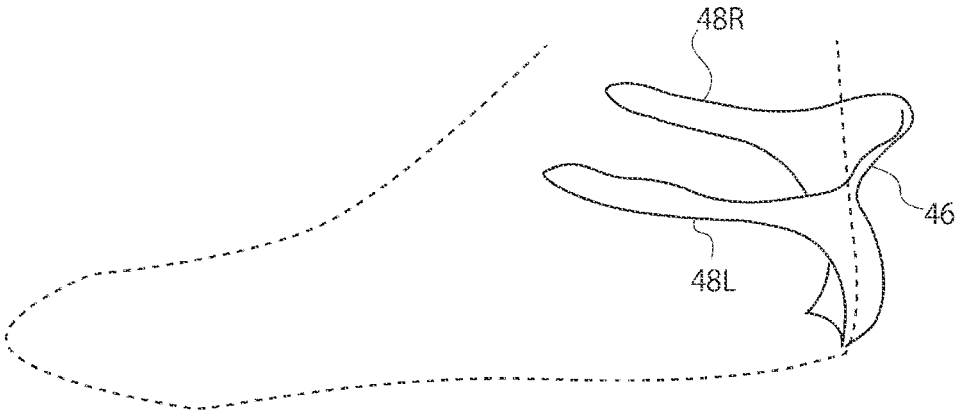
FIG. 20 is a side view of a heel member according to a modification.

FIG. 20 is a side view of a heel member according to a further modification. As illustrated in FIG. 20, a heel member 46 includes a pair of ankle holding portions 48L and 48R that come into contact with the sides of the wearer's ankle when the wearer's foot is placed on the sole 14 (see FIG. 2). The ankle holding portions 48L and 48R are formed by a pair of arms extending from near the boundary between the guiding portion 22 and the heel holding portion 24 toward the toe side. The ankle holding portions 48L and 48R extend along both sides of the edge part 122 of the wearing opening 120 (see FIG. 2). Each of the ankle holding portions 48L and 48R can extend from the inside of the upper 12, over the edge part 122, and along the outer surface of the upper 12. The ankle holding portions 48L and 48R function as heel counters. Therefore, providing the ankle holding portions 48L and 48R can improve the landing stability and support for walking.

The present invention are not limited to the aforementioned embodiment and modifications thereof, and changes can be appropriately made to each configuration in the embodiment without departing from the spirit of the present disclosure.

The present disclosure is industrially applicable to the field of shoes.

The invention claimed is:

1. A shoe, comprising a sole;

an upper fixed to the sole and configured to cover a foot of a wearer, the upper including a wearing opening; and a heel member disposed on a heel side of the wearing opening of the upper, the heel member including a holding portion and a guiding portion, the guiding portion configured to guide a heel of the wearer toward the wearing opening, the guiding portion including a receiving surface with which the heel is configured to contact and generally faces in a direction toward a front of the shoe and is at a highest position in the heel member, the guiding portion having a first spread angle at a location of the receiving surface that is inclined downward in the direction toward the front of the shoe and where the heel member is nonsymmetrical from a top view at the location, the holding portion having a curved surface that is continuous with the receiving surface and has a second spread angle that is less than the first spread angle, the holding portion configured to hold the guiding portion with respect to the upper at least in a vertical direction.

2. The shoe according to claim 1, wherein when the shoe is placed on a virtual plane, the receiving surface is parallel to the virtual plane or on a toe side facing upward.

3. The shoe according to claim 2, wherein the guiding portion is highest at an end on a heel side.

4. The shoe according to claim 2, wherein the guiding portion has a curved shape that opens on a toe side on a horizontal cross section, the the holding portion has a curved shape opening toward a toe side on a horizontal cross section and is configured to at least partially contact a rear part of an ankle of the wearer, and at least part of an opening width of the holding portion is smaller than an opening width of the guiding portion.

5. The shoe according to claim 4, wherein the guiding portion is highest at an end on a heel side.

6. The shoe according to claim 4, wherein a through hole having an oval shape is disposed in the heel member so as to open continuously from the guiding portion to the holding portion.

7. The shoe according to claim 2, wherein the holding portion is fixed to at least one of the upper or the sole.

8. The shoe according to claim 2, wherein the heel member includes a heel side holding portion configured to hold the heel of the wearer at sides thereof when the foot of the wearer is placed on the sole.

9. The shoe according to claim 2, wherein a toe side portion of the wearing opening is stretchable.

10. The shoe according to claim 2, wherein the heel member is a single plate extending vertically continuously.

11. The shoe according to claim 1, wherein the guiding portion is highest at an end on a heel side.

12. The shoe according to claim 11, wherein the holding portion is fixed to at least one of the upper or the sole.

13. The shoe according to claim 1, wherein the guiding portion has a curved shape that opens on a toe side on a horizontal cross section, the holding portion has a curved shape opening toward a toe side on a horizontal cross section and is configured to at least partially contact a rear part of an ankle of the wearer, and at least part of an opening width of the holding portion is smaller than an opening width of the guiding portion.

14. The shoe according to claim 13, wherein a portion of the holding portion configured to contact the rear part of the ankle of the wearer includes a buffer member.

15. The shoe according to claim 13, wherein a through hole having an oval shape is disposed in the heel member so as to open continuously from the guiding portion to the holding portion.

16. The shoe according to claim 1, wherein the holding portion is fixed to at least one of the upper or the sole.

17. The shoe according to claim 1, wherein the heel member includes a heel side holding portion configured to hold the heel of the wearer at sides thereof when the foot of the wearer is placed on the sole.

18. The shoe according to claim 1, wherein a toe side portion of the wearing opening is stretchable.

19. The shoe according to claim 1, wherein the heel member is a single plate extending vertically continuously.

20. The shoe according to claim 1, wherein the heel member is disposed inside the wearing opening, and a top end of the guiding portion is positioned higher than a top edge of the wearing opening.

* * * * *